US006438888B1

(12) United States Patent
Lin et al.

(10) Patent No.: US 6,438,888 B1
(45) Date of Patent: Aug. 27, 2002

(54) FIXTURE FOR QUICKLY CLIPPING ACCESSORY ON PISTOL

(75) Inventors: Paul Lin; Yu-Hsi Yang, both of Taipei (TW)

(73) Assignee: Quarton, Inc. (TW)

( * ) Notice: Subject to any disclaimer, the term of this patent is extended or adjusted under 35 U.S.C. 154(b) by 0 days.

(21) Appl. No.: 09/778,514

(22) Filed: Feb. 7, 2001

(51) Int. Cl.[7] ..... F41G 1/34; F41G 1/38

(52) U.S. Cl. ..... 42/114; 42/124; 42/127; 42/146; 362/110

(58) Field of Search ..... 42/115, 124, 114, 42/127, 146, 148; 362/110

(56) References Cited

U.S. PATENT DOCUMENTS 4,542,447 A * 9/1985 Quakenbush ..... 200/60
5,040,322 A * 8/1991 Iturrey, Jr. ..... 362/110
5,107,612 A * 4/1992 Bechtel ..... 42/115
5,282,594 A * 2/1994 Huang ..... 248/205.1
5,430,967 A * 7/1995 Woodman et al. ..... 362/110
5,581,898 A * 12/1996 Thummel ..... 42/114
5,758,448 A * 6/1998 Thummel ..... 362/114
6,185,854 B1 * 2/2001 Solinsky et al. ..... 362/110
6,276,088 B1 * 8/2001 Matthews et al. ..... 362/110

* cited by examiner

*Primary Examiner*—Charles T. Jordan
*Assistant Examiner*—John W. Zerr
(74) *Attorney, Agent, or Firm*—Raymond Sun

(57) ABSTRACT

A fixing rack for use in quickly clipping an accessory on to a pistol has an elastic clipping seat made of an elastic sheet having two opposing sides that are bent upwardly and inwardly to a preset angle. Each side of the elastic sheet has an inwardly-extending flange, and the two flanges defining an opening therebetween that varies in width when the sides are flexed. The fixing rack also includes two releasing plates, each releasing plate attached to one of the two sides of the elastic sheet to flex the two sides. The fixing rack also includes a fixing sheath attached below the clipping seat, the fixing sheath having a chamber for receiving a pistol accessory. The fixing rack can be quickly and conveniently attached to a pistol by flexing the releasing plates to widen the opening between the flanges, thereby allowing the flanges to be slid into corresponding wedging grooves in a pistol.

16 Claims, 8 Drawing Sheets

FIXTURE FOR QUICKLY CLIPPING ACCESSORY ON PISTOL

BACKGROUND OF THE INVENTION

1. Field of the Invention

The present invention relates to a fixture for a pistol accessory, and in particular to a fixture for quickly clipping an accessory on to a pistol.

2. Description of the Prior Art

The conventional fixing rack for a pistol accessory is normally used to secure a pistol accessory on the trigger guard of a pistol. Referring to FIGS. 1 and 2, a conventional fixing rack comprises a fixing base 12, a fixing sheath 16 and a connecting plate 14. The fixing base 12 has an L-shaped base plate 122 and an arc body 124 that are connected by a bridge element 126. A space 123 is disposed between the L-shaped base plate 122 and the arc body 124. A plurality of threaded holes 125 are positioned at the flank sides of the L-shaped base plate 122 and the arc body 124, and another threaded hole 127 adapted to receive a short bolt 128 is also positioned at the short edge of the L-shaped base plate 122. A plurality of round holes 145, aligned with the threaded holes 125 that are positioned at the flank sides of the L-shaped base plate 122 and the arc body 124, are positioned on the connecting plate 14 in order to connect and fix the connecting plate 14 to the fixing base 12. A circular through hole 162, having a longitudinally cut groove 164 therein, is disposed in the fixing sheath 16, with one end of the cut groove 164 transitioning to a curved groove 166 that is perpendicular to the cut grove 164. A plurality of threaded holes 168 and 167 are positioned along the bottom of the fixing sheath 16. A laser sight (not shown) can be inserted in the circular through hole 162, and a bolt 184 can be screwed into the hole 168 to secure the laser sight tightly in the circular through hole 162 because the existence of the cut groove 164 allows the cylindrical body of the sheath 16 to be flexed inwardly to clamp the laser sight when the bolt 184 is screwed tightly inside the hole 168. In addition, the sheath 16 can be secured to the fixing base 12 by securing bolts 182 through the holes 167 and into aligned holes 125 on the L-shaped base plate 122.

In use, the trigger guard 25 of a pistol 20 is inserted into the space 123 of the fixing base 12, and then the connecting plate 14 is secured to the L-shaped base plate 122 via the bolts 182, the openings 145 and the holes 125. After that, the short bolt 128 is screwed into the hole 127 to press tightly against the trigger guard 25 so that the arc body 124 and the short bolt 128 can clamp the trigger guard 25 so as to prevent the fixing rack from shaking.

Unfortunately, the fixing base 12 of the conventional fixing rack described above is locked on the trigger guard 25 of the pistol 20. This makes it not only inconvenient to assemble and disassemble, but also limits the space inside the trigger guard, hindering a user's finger during operation of the pistol. Additionally, not all front ends of trigger guards of pistols are perpendicular and smooth, so the axial line of the fixing base 12 will deviate from the sight line, making it difficult obtain an accurate aim.

SUMMARY OF THE INVENTION

It is an object of the present invention to provide a fixture for a pistol accessory that is easy to assemble and disassemble from the pistol.

It is another object of the present invention to provide a fixture for a pistol accessory that assures that the axial line of the fixture is aligned with the sight line of the pistol.

It is yet another object of the present invention to provide a fixture for a pistol accessory that can be tightly secured to the pistol during use to prevent the fixture from shaking or misalignment.

The objects of the present invention can be accomplished by providing a fixing rack for use in quickly clipping an accessory on to a pistol. The fixing rack has an elastic clipping seat made of an elastic sheet having two opposing sides that are bent upwardly and inwardly to a preset angle, each side having an inwardly-extending flange, and the two flanges defining an opening therebetween that varies in width when the sides are flexed. The fixing rack also includes two releasing plates, each releasing plate attached to one of the two sides of the elastic sheet to flex the two sides. The fixing rack also includes a fixing sheath attached below the clipping seat, the fixing sheath having a chamber for receiving a pistol accessory. The fixing rack can be quickly and conveniently attached to a pistol by flexing the releasing plates to widen the opening between the flanges, thereby allowing the flanges to be slid into corresponding wedging grooves in a pistol.

In accordance with another embodiment of the present invention, the fixing rack has an elastic clipping seat made of an elastic sheet having two opposing sides that are bent upwardly and inwardly to a preset angle. The fixing rack also has two releasing plates, each releasing plate having an inwardly-extending flange, the two flanges defining an opening therebetween that varies in width when the releasing plates are flexed. Each releasing plate is attached to one of the two sides of the elastic sheet to flex the two sides. The fixing rack also includes a fixing sheath attached below the clipping seat, the fixing sheath having a chamber for receiving a pistol accessory. The fixing rack can be quickly and conveniently attached to a pistol by flexing the releasing plates to widen the opening between the flanges, thereby allowing the flanges to be slid into corresponding wedging grooves in a pistol.

DETAILED DESCRIPTION OF THE PREFERRED EMBODIMENT

Figure 1:
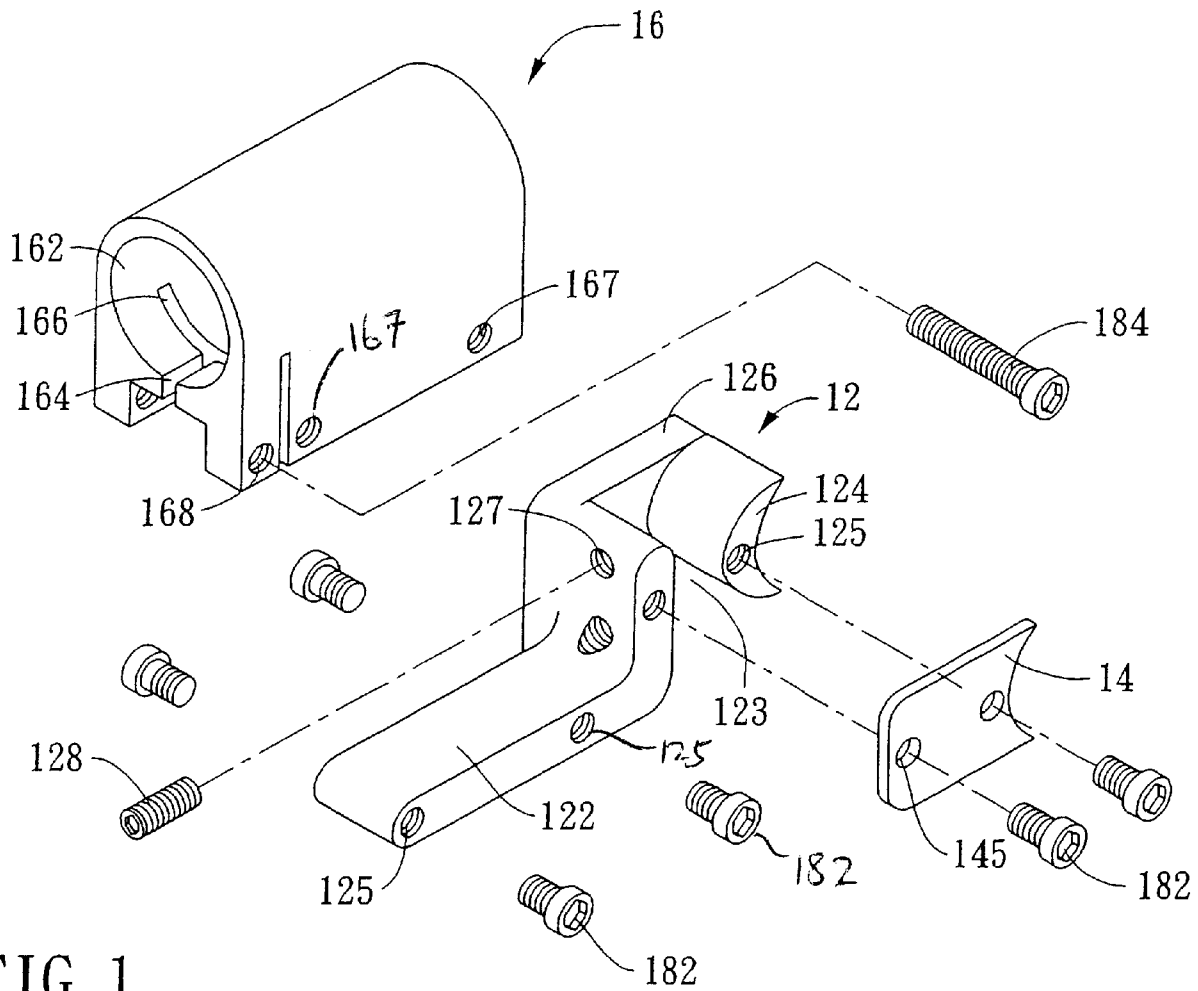
FIG. 1 (PRIOR ART)
FIG. 1 is an exploded perspective view of a conventional laser sight fixing rack.
Figure 2:
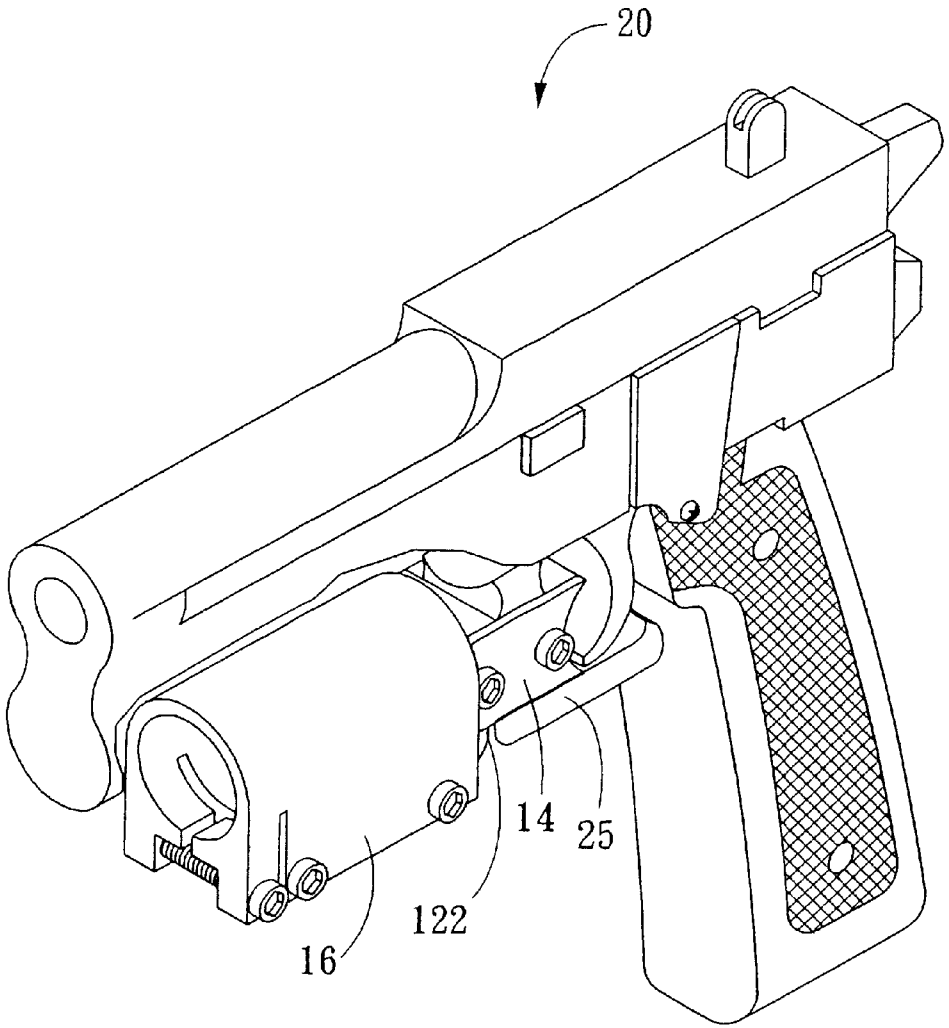
FIG. 2 (PRIOR ART)
FIG. 2 is a perspective view of the fixing rack of FIG. 1, shown attached to a pistol.
Figure 3:
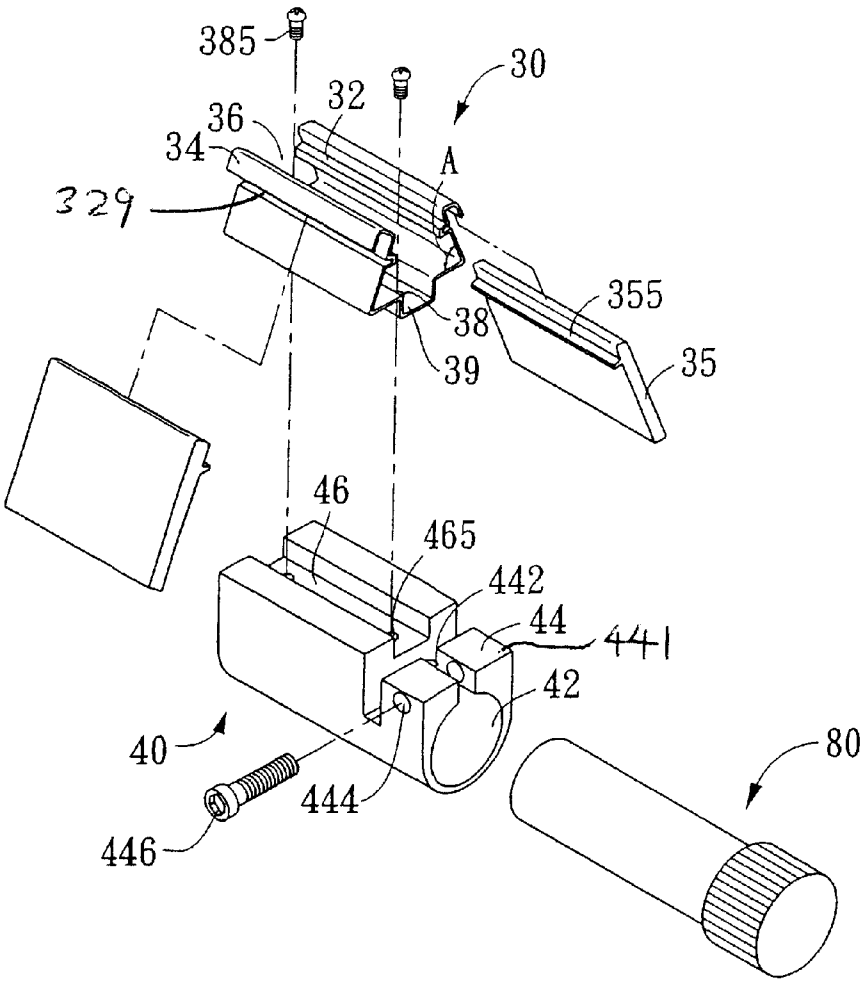
FIG. 3 is an exploded perspective view of one embodiment of a laser sight fixing rack according to the present invention.
Figure 4:
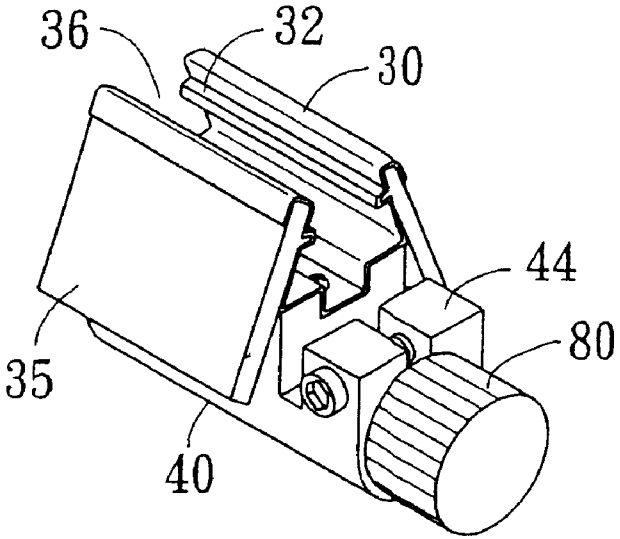
FIG. 4 is a perspective view of the fixing rack of FIG. 3.

FIGS. 3 and 4 illustrate one embodiment of a laser sight fixing rack according to the present invention, which has an elastic clipping seat 30, a fixing sheath 40 and a pair of releasing plates 35. The elastic clipping seat 30 can be made from a thin elastic sheet with, two opposite sides of the thin sheet bent upward and inward towards each other to a preset acute angle A and folded inwardly. A flange 32 is formed at each inner surface of each side of the elastic sheet 30. An opening 36 is defined between the two flanges 32 at the two sides of the elastic clipping seat 30. The outermost edges of each side of the seat 30 are folded outwardly to form a press plate 34 along each side. Each releasing plate 35 can be inserted into one of the press plates 34 of the elastic clipping seat 30, with a projecting strip 355 disposed on one surface of each releasing plate 35 being inserted into a corresponding groove 329 that is formed behind each flange 32 of the elastic clipping seat 30. Fitting the strip 355 inside a corresponding groove 329 provides a more secure attachment of each releasing plate 35 to a corresponding press plate 34. Each releasing plate 35 is normally biased toward each other.

The fixing sheath 40 has a chamber or holding hole 42 provided therein for receiving a pistol accessory 80 therein. The fixing sheath 40 is fixed under the elastic clipping seat 30. A U-shaped clamping ring 44 is provided at one end of the fixing sheath 40. The clamping ring 44 has two flank sides 441 with a longitudinal slot 442 defined between the two flank sides 441. A threaded hole 444 is provided in each flank side 441 and are aligned with each other, and a bolt 446 can be screwed through the holes 444 to clamp the two flank sides 441 together. When the pistol accessory 80 is positioned inside the holding hole 42, screwing the bolt 446 allows the flank sides 441 to grip the pistol accessory 80 and to prevent it from moving after it has been secured inside the fixing sheath 40.

The clipping seat 30 has a central longitudinal groove 39 that is provided at its bottom side and defines an extension. The groove 39 has at least one round hole 38 at its bottom side, such as at the center part of the elastic clipping seat 30. A corresponding groove 46 that has threaded holes 465 (aligned with the round holes 38 in the elastic clipping seat 30) is disposed at the top surface of the fixing sheath 40, so that the elastic clipping seat 30 and the fixing sheath 40 can be secured together by screws 385. Since the groove 46 receives the extension of the groove 39, the groove 46 not only functions to accept the screws 385, but also functions to provide a more secure attachment of the clipping seat 30 and the fixing sheath 40 (i.e., slippage of the clipping seat 30 with respect to the fixing sheath 40 will be prevented).

Figure 5A:
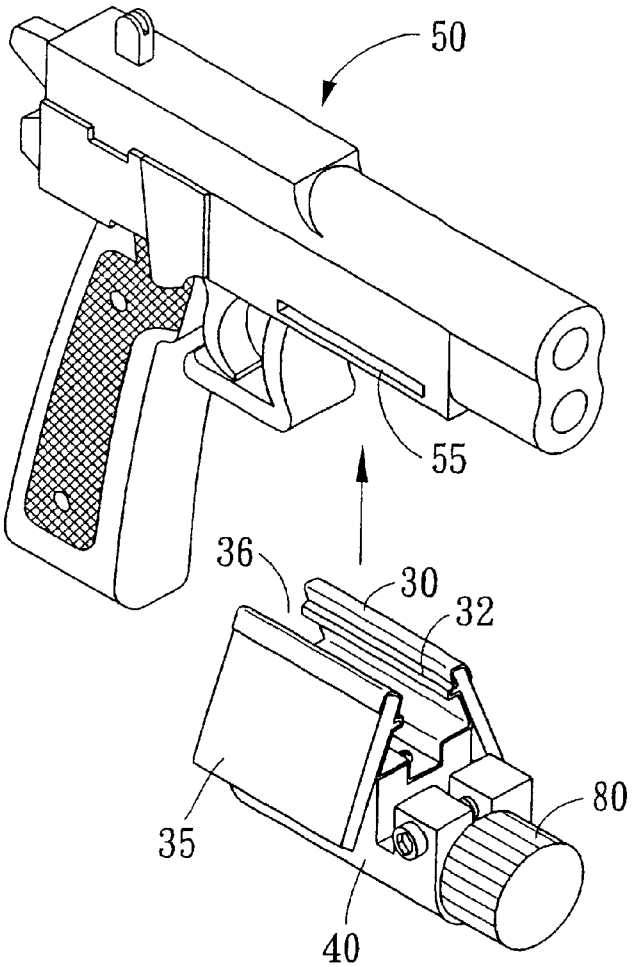
FIGS. 5A and 5B are perspective views showing how the fixing rack of FIGS. 3 and 4 attaches to and detaches from a pistol.
Figure 5B:
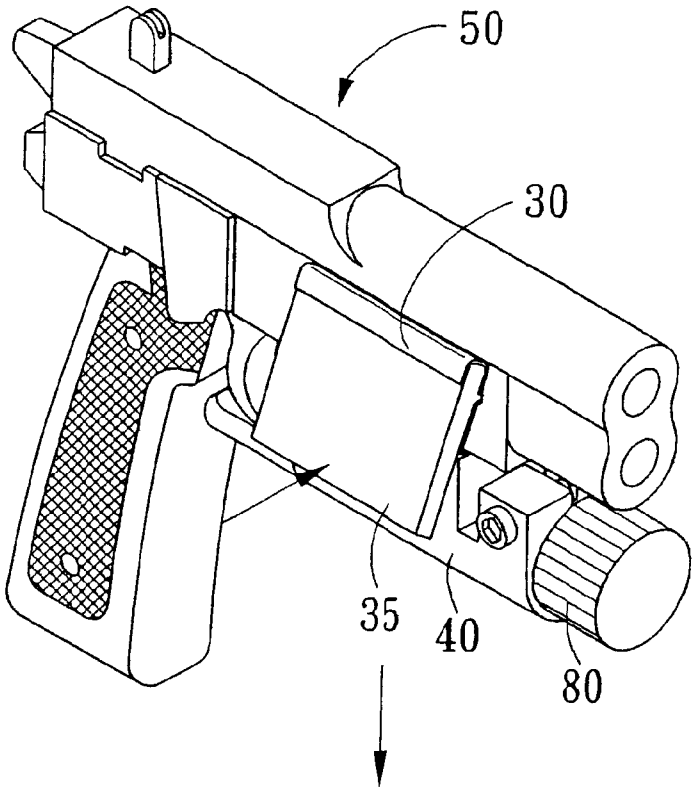

Referring now to FIGS. 5A and 5B, the fixing rack of the present invention is secured to a pistol 50 by aiming the opening 36 of the elastic clipping seat 30 at the wedging grooves 55 on either side of the pistol 50, and lifting the fixing rack upwardly while flexing the press plates 34 away from each other (e.g., by pressing the plates 35), so that the opening 36 is widened for the flanges 32 to slip into the wedging grooves 55 to be secured to the pistol 50. Since the width of the opening 36 is normally smaller than the width of the bottom edge of the pistol 50, the flanges 32 will be biased inside the wedging grooves 55 to secure and grip the pistol 50. When the fixing rack is to be removed from the pistol 50, it is only necessary to press the releasing plates 35 opposite the bias of the releasing plates 35, so as to widen the opening 36 to enable the flanges 32 to disengage the wedging grooves 55 and the fixing rack to be released. Since the wedging grooves 55 are disposed along the bottom edge of the barrel of the pistol 50 and are parallel therewith, the axial line of the fixing rack can be consistently aligned with the axial line of the pistol barrel.

Figure 6:
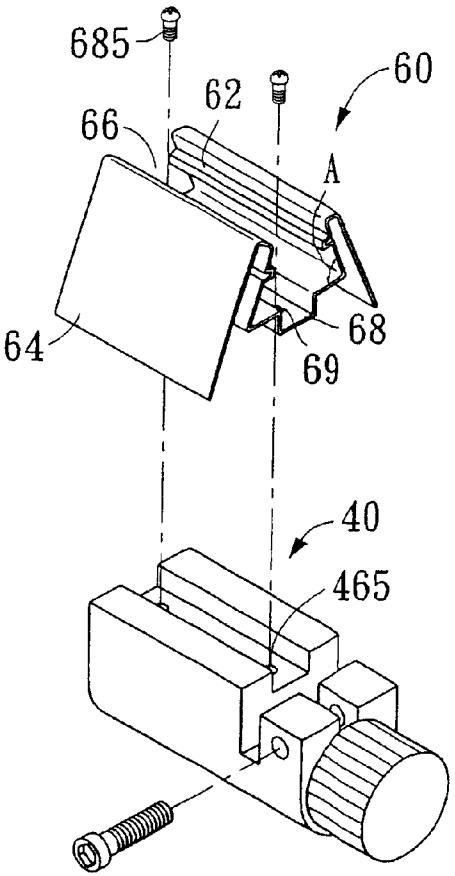
FIG. 6 is an exploded perspective view of another embodiment of a laser sight fixing rack according to the present invention.

FIG. 6 illustrates a second embodiment of a fixing rack according to the present invention. In the fixing rack of FIG. 6, the fixing sheath 40 can be identical to the fixing sheath 40 in FIGS. 3–4, and the clipping seat 60 in FIG. 6 is essentially the same as the clipping seat 30 in FIGS. 3–4 except that the releasing plates 35 in FIGS. 3–4 have been integrated into the press plate 34 to form a single press plate 64. Otherwise, the flanges 62, opening 66, groove 69, round holes 68 and screws 685 in FIG. 6 are the same as the flanges 32, opening 36, groove 39, round holes 38 and screws 385 in FIGS. 3–4, and shall not be described in greater detail.

In the clipping seat 60 of FIG. 6, the pre-bent thin elastic sheet that makes up the clipping seat 60 is folded in the same manner as the clipping seat 30 in FIGS. 3–4. The outermost edges of each side of the clipping seat 60 are also folded outwardly to form a press plate 64. Each press plate 64 can extend for a longer distance than the press plates 34 in FIGS. 3–4, so that the extended press plates 64 themselves perform the same flexing function as the releasing plates 35 in FIGS. 3–4.

The operation of the fixing rack of FIG. 6 is the same as for the fixing rack of FIGS. 3–4. To secure the fixing rack (with the pistol accessory 80 secured inside the holding hole 42 of the fixing sheath 40) to the pistol 50, the press plates 64 are pressed by the user to flex them and to thereby widen the opening 66. The fixing rack is then lifted up so that the barrel of the pistol 50 is inserted through the opening 66 until the flanges 62 are received and biased inside the wedging grooves 55 of the pistol 50. To remove the fixing rack and its pistol accessory 80, the press plates 64 are again pressed to widen the opening 66, so that the fixing rack can be removed from the pistol barrel.

Figure 7:
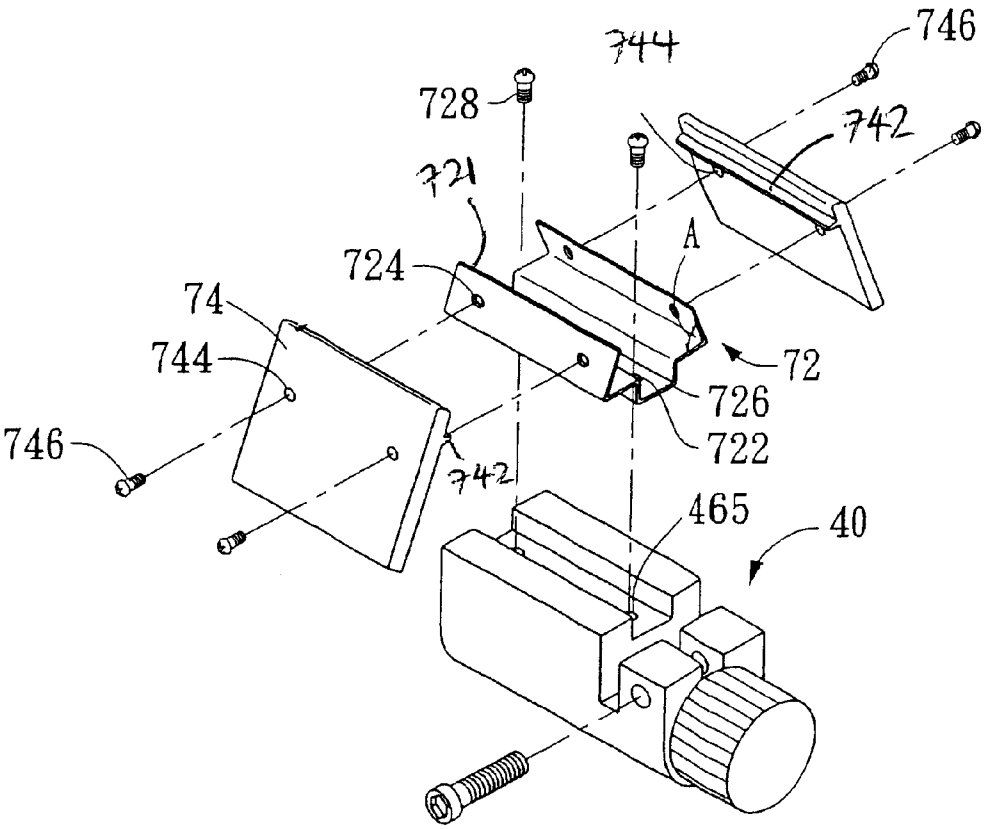
FIG. 7 is an exploded perspective view of yet another embodiment of a laser sight fixing rack according to the present invention.

FIG. 7 illustrates a third embodiment of a fixing rack according to the present invention. In the fixing rack of FIG. 7, the fixing sheath 40 can be identical to the fixing sheath 40 in FIGS. 3–4, and the clipping seat 72 in FIG. 7 is essentially the same as the clipping seat 30 in FIGS. 3–4 except that the press plates 34 in FIGS. 3–4 are omitted, and the releasing plates 35 in FIGS. 3–4 are instead directly attached to the angled sides of the thin elastic sheet of the clipping seat 72, with the flanges carried on the releasing plates instead of on the clipping seat 72.

In particular, the clipping seat 72 can be made from a thin elastic sheet that can be the same material as the thin elastic sheet for clipping seat 30. The two opposing sides of the elastic sheet 72 are bent upward and inward towards each other to a preset acute angle A. Threaded openings 724 are provided on each side of the elastic sheet 72. Each releasing plate 74 has a flange 742 provided on its inner surface, and positioned above threaded openings 744 that are aligned with corresponding threaded openings 724 on the sides of the elastic sheet 72. Each releasing plate 74 can be attached to a corresponding side of the elastic sheet 72 by either welding, or by inserting a screw 746 through each set of aligned openings 744 and 724. When each releasing plate 74 is attached to the elastic sheet 72, the flange 742 of each releasing plate 74 is positioned above the top edge 721 of each side of the elastic sheet 72 to protrude into the interior space of the clipping seat 72.

The clipping seat 72 has a central longitudinal groove 726 and round holes 722 that are the same as groove 39 and round holes 38, respectively, in FIGS. 3–4. Screws 728 can be inserted through aligned sets of holes 722 and 465 to secure the clipping seat 72 to the central longitudinal groove 46 of the fixing sheath 40 in the same manner described in connection with FIGS. 3–4.

The operation of the fixing rack of FIG. 7 is the same as for the fixing rack of FIGS. 3–4. To secure the fixing rack (with the pistol accessory 80 secured inside the holding hole 42 of the fixing sheath 40) to the pistol 50, the releasing plates 74 are pressed by the user to flex them and to thereby widen the opening between the flanges 742 of the two releasing plates 74. The fixing rack is then lifted up so that the barrel of the pistol 50 is inserted through the opening until the flanges 742 of the releasing plates 74 are received and biased inside the wedging grooves 55 of the pistol 50. To remove the fixing rack and its pistol accessory 80, the releasing plates 74 are again pressed to widen the opening between the flanges 742 of the two releasing plates 74, so that the fixing rack can be removed from the pistol barrel.

Thus, the fixing racks according to the present invention provide elastic clipping seats that can be quickly and conveniently clipped onto, and removed from, the barrel of a pistol. The use of the elastic clipping seats also maintain a consistent axial alignment between the laser sight and the pistol barrel.

What is claimed is:

1. A fixing rack for use in quickly clipping an accessory on to a pistol, comprising:

an elastic clipping seat made of an elastic sheet having two opposing sides that are bent upwardly and inwardly to a preset angle, each side having an inwardly-extending flange, the two flanges defining an opening therebetween that varies in width when the sides are flexed, the clipping seat further including two releasing plates, each releasing plate formed in one piece with one of the two sides of the elastic sheet to flex the two sides; and a fixing sheath attached below the clipping seat, the fixing sheath having a chamber for receiving a pistol accessory.

2. The fixing rack of claim 1, wherein the elastic sheet has a bottom side that is attached to the fixing sheath.

3. The fixing rack of claim 2, wherein the fixing sheath has a top surface, and a longitudinal groove provided in the top surface, with the elastic sheet having a longitudinal extension that is received in the longitudinal groove when the clipping seat is secured to the fixing sheath.

4. The fixing rack of claim 1, wherein a clamping ring is provided at a front end of the fixing sheath, the clamping ring having two flank sides that define a slot therebetween, with a threaded hole provided in each flank side, and a bolt that is inserted through the threaded holes in each flank side to cause the two flank sides to be drawn towards each other.

5. A fixing rack for use in quickly clipping an accessory on to a pistol, comprising:

an elastic clipping seat made of an elastic sheet having two opposing sides that are bent upwardly and inwardly to a preset angle, each side having an inwardly-extending flange, the two flanges defining an opening therebetween that varies in width when the sides are flexed;

two releasing plates, each releasing plate being separate from the elastic sheet, and each releasing plate attached to one of the two sides of the elastic sheet to flex the two sides; and a fixing sheath attached below the clipping seat, the fixing sheath having a chamber for receiving a pistol accessory.

6. The fixing rack of claim 5, wherein each side of the elastic sheet has a press plate that extends outwardly, and each releasing plate is secured between a corresponding side and press plate of the elastic sheet.

7. The fixing rack of claim 6, wherein each side of the elastic sheet has a groove, and each releasing plate has a strip that is filted into the groove of the corresponding side of the elastic sheet.

8. The fixing rack of claim 5, wherein the elastic sheet has a bottom side that is attached to the fixing sheath.

9. The fixing rack of claim 8, wherein the fixing sheath has a top surface, and a longitudinal groove provided in the top surface, with the elastic sheet having a longitudinal extension that is received in the longitudinal groove when the clipping seat is secured to the fixing sheath.

10. The fixing rack of claim 5, wherein a clamping ring is provided at a front end of the fixing sheath, the clamping ring having two flank sides that define a slot therebetween, with a threaded hole provided in each flank side, and a bolt that is inserted through the threaded holes in each flank side to cause the two flank sides to be drawn towards each other.

11. A fixing rack for use in quickly clipping an accessory on to a pistol, comprising:

an elastic clipping seat made of an elastic sheet having two opposing sides that are bent upwardly and inwardly to a preset angle;

two releasing plates, each releasing plate having an inwardly-extending flange, the two flanges defining an opening therebetween that varies in width when the releasing plates are flexed, each releasing plate attached to one of the two sides of the elastic sheet to flex the two sides; and a fixing sheath attached below the clipping seat, the fixing sheath having a chamber for receiving a pistol accessory.

12. The fixing rack of claim 11, wherein each releasing plate is a separate piece that is attached to a corresponding side of the elastic sheet.

13. The fixing rack of claim 11, wherein the elastic sheet has a bottom side that is attached to the fixing sheath.

14. The fixing rack of claim 13, wherein the fixing sheath has a top surface, and a longitudinal groove provided in the top surface, with the elastic sheet having a longitudinal extension that is received in the longitudinal groove when the clipping seat is secured to the fixing sheath.

15. The fixing rack of claim 11, wherein a clamping ring is provided at a front end of the fixing sheath, the clamping ring having two flank sides that define a slot therebetween, with a threaded hole provided in each flank side, and a bolt that is inserted through the threaded holes in each flank side to cause the two flank sides to be drawn towards each other.

16. The fixing rack of claim 11, wherein each side of the elastic sheet has an upper edge, and wherein each flange extends above the upper edge of the corresponding side of the elastic sheet.

* * * * *